United States Patent [19]

Priam-Doizi

[11] Patent Number: 4,562,785

[45] Date of Patent: Jan. 7, 1986

[54] SELF-STABLE TRIMARAN

[76] Inventor: Patrice M. Priam-Doizi, F-17920 Breuillet, France

[21] Appl. No.: 438,900

[22] PCT Filed: Mar. 1, 1982

[86] PCT No.: PCT/FR82/00035

§ 371 Date: Oct. 29, 1982

§ 102(e) Date: Oct. 29, 1982

[30] Foreign Application Priority Data

Feb. 27, 1981 [FR] France ..... 81 03915

[51] Int. Cl.[4] ..... B63B 43/14

[52] U.S. Cl. ..... 114/39; 114/121; 114/123

[58] Field of Search ..... 114/39, 61, 121, 123, 114/125, 283

[56] References Cited

U.S. PATENT DOCUMENTS

| | | | |
|---|---|---|---|
| 4,102,287 | 7/1978 | Ferris | 114/39 |
| 4,117,795 | 10/1978 | Ruiz | 114/61 |
| 4,227,474 | 10/1980 | Ullrich | 114/61 |
| 4,441,445 | 4/1984 | DeWeck | 114/125 |

FOREIGN PATENT DOCUMENTS

| | | | |
|---|---|---|---|
| 628581 | 3/1982 | Switzerland | 114/121 |

*Primary Examiner*—Trygve M. Blix
*Assistant Examiner*—Edwin L. Swinehart
*Attorney, Agent, or Firm*—Robert J. Koch

[57] ABSTRACT

A trimaran sailing boat permitting the automatic return to a stable equilibrium corresponding to a normal sailing position from any position. This is accomplished by filling of submergeable watertight floats with water and rapid discharge of the water which causes the automatic rotation of the floats. The force developed causes the return to the normal sailing position.

3 Claims, 6 Drawing Figures

SELF-STABLE TRIMARAN

Figure 1:
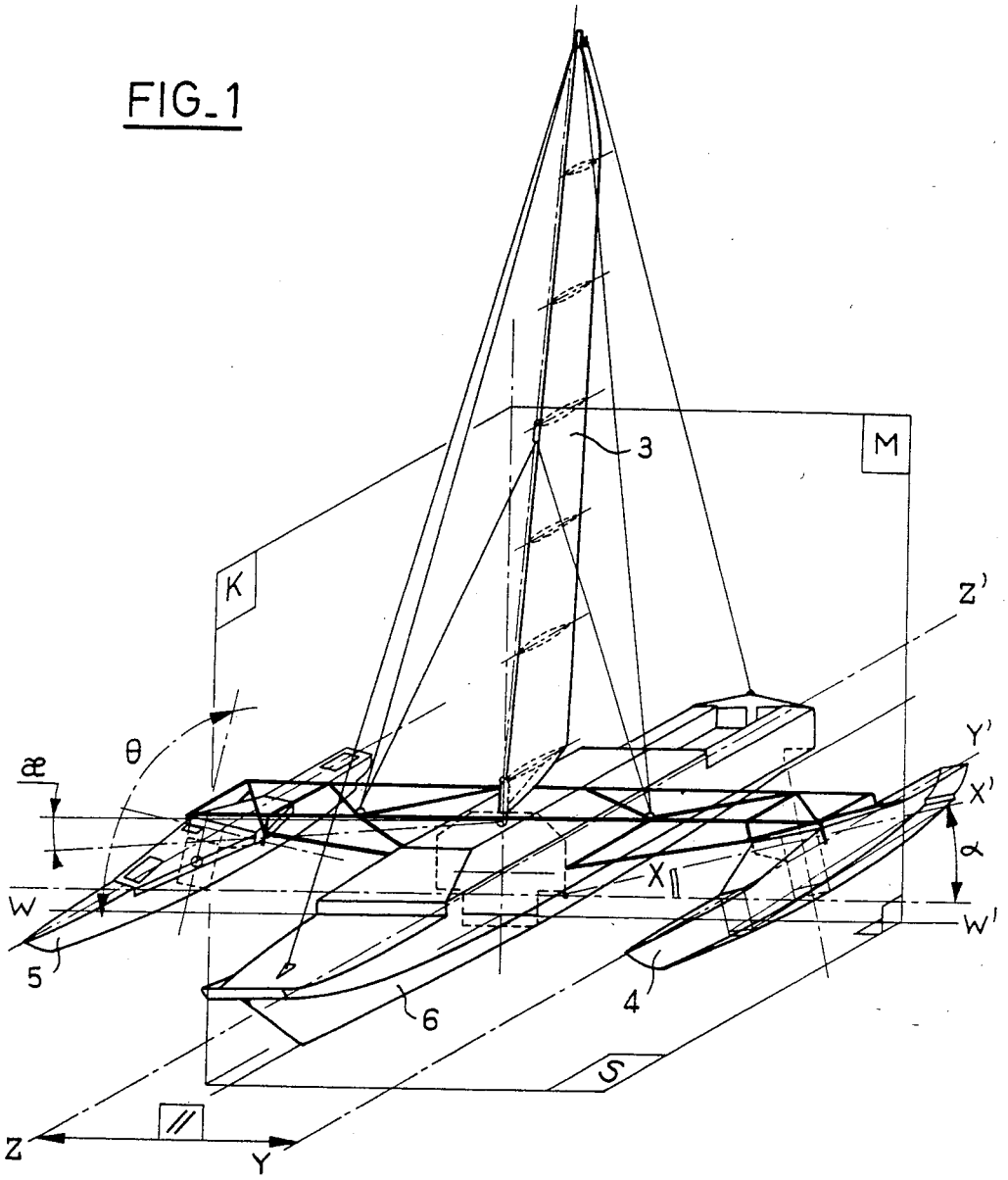

The present invention relates to trimaran type sailboats permitting from any position the automatic return to a stable equilibrium corresponding to a normal sailing position.

In known designs of this kind the central hull is equipped with two constant volume lateral floats which are submergible or insubmergible. These three members are connected by beams which are very often of considerable constant volume. In general, the assemblies are rigid or flexible or even with very slight displacement and the sole function of the mast is to carry the sails. Such sailing designs cause permanent torsional stresses and the risk of plunging the float or the central hull because the waves can conceivably urge them at the same time. It is also known that this type of boat has a stability curve which decreases, in order to tend toward a second stable equilibrium position, which is reached when the boat is overturned. This design means the axis of symmetry, which is necessary for sailing and the weight of the mast, both function as ballast. It is therefore impossible for it to return to its initial sailing position on its own.

The trimaran according to the invention permits these drawbacks to be avoided. It is characterized by the association, with the sails and the floats, of means forming fluidtight submergible volumes, creating potential energy capable of displacement by rotational movement to destroy the symmetry. Each float is submergible and has a variable volumetric displacement comprising a main fluidtight volume located at the level of the bow, a second minimum fluidtight volume included between the bottom of the hull and the planking, a hollow volume which may be filled through openings at the level of the deck, and a quick discharge valve located toward the stern, the base of which corresponds to the level of the planking. The float is fixed to connecting arms which are of as small a volume as possible, by a cylindrical shaft, which shaft permits only freedom of rotation between the two abutments so that it may fluctuate between an approximately horizontal position and an almost vertical position. The two abutments are obtained by the connecting arms, limiting the rotation of the float which may occur freely in both directions, while having a means for ensuring upward rotation to obtain the vertical position against the abutment. This axis of rotation is located close to the center of buoyancy of the hull where the heel obtained in sailing is included within the clearance.

The mast and the floats are placed so that the boat, during righting, effects rotation about the longitudinal volumes of the center hull containing, to a great extent, the resultant forces due to the weight of the different elements and the axis of rotation located in the plane of symmetry, this axis having to remain as parallel as possible to the surface of the water. When the boat has overturned, the position of the floats relative to the surface of the water is such that it can roll on its side.

According to a combination of modifications concerning the fluidtight volumes, they are nondeformable compartments which operate immediately, or they are casings which are deformable by inflation under pressure, or even a combination of nondeformable and deformable volumes.

According to a further variant concerning the rotation of the float upwards when the boat is recumbent on the water, such rotation is obtained automatically due to the lack of symmetry of the float's axis of rotation which, in a first case, forms an acute angle with a straight line parallel to the surface of the water, this angle lying in a vertical plane, perpendicular to the axis of rotation of the boat, so that the bow of the float moves toward the plane of symmetry of the boat and the surface of the water, which, in a second case, forms an acute angle with a straight line perpendicular to the axis of rotation of the boat, this angle lying in a horizontal plane parallel to the surface of the water, so that the bow of the float moves toward the plane of symmetry and the surface of the water, in both cases the longitudinal axis of the float is parallel to the axis of rotation of the boat or hugs slightly; or by a righting system controlled by the crew giving a free choice as to the orientation of the axis of rotation of the float. For safety reasons it is also possible to combine the means by using automatic righting and controlled righting.

The device according to the invention permits the boat, regardless of its position, to return to a single stable equilibrium corresponding to its normal sailing position; but also to diminish the risks of capsizing, for the central hull and the float in wind navigate side by side, each reacting in their own way causing torsional stresses and plunging of the float.

Figure 2:
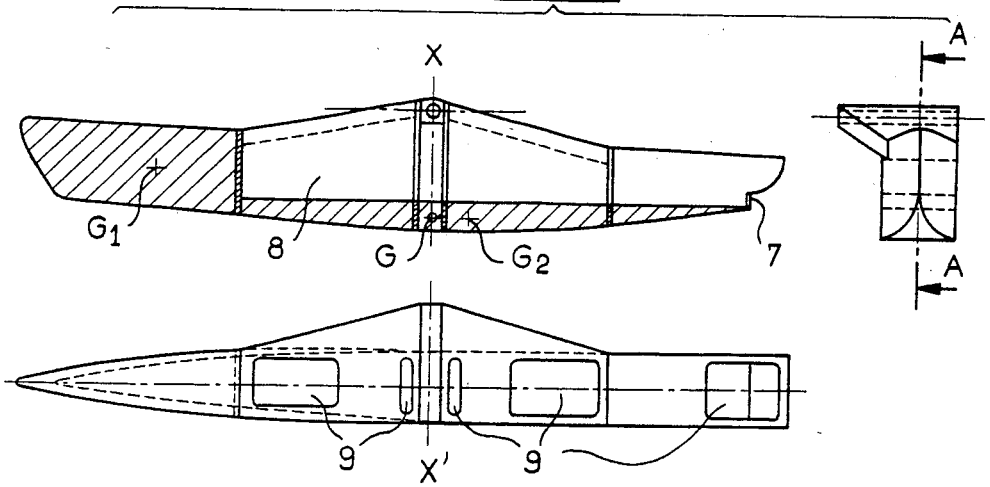
Figure 3:
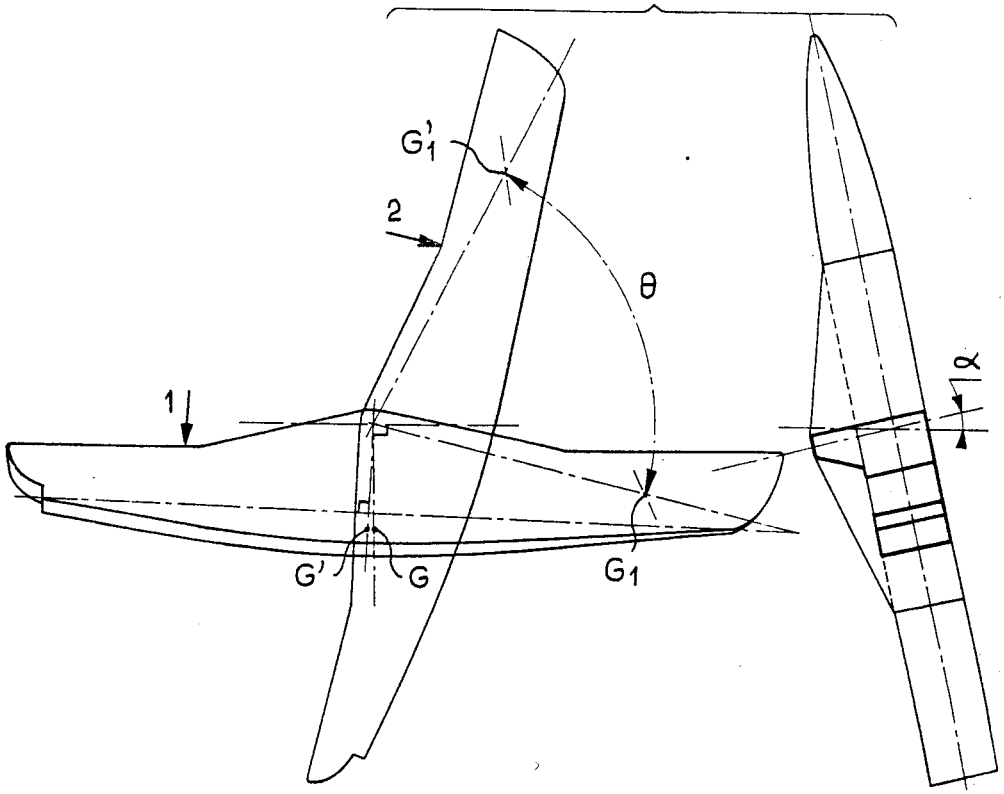
Figure 4:
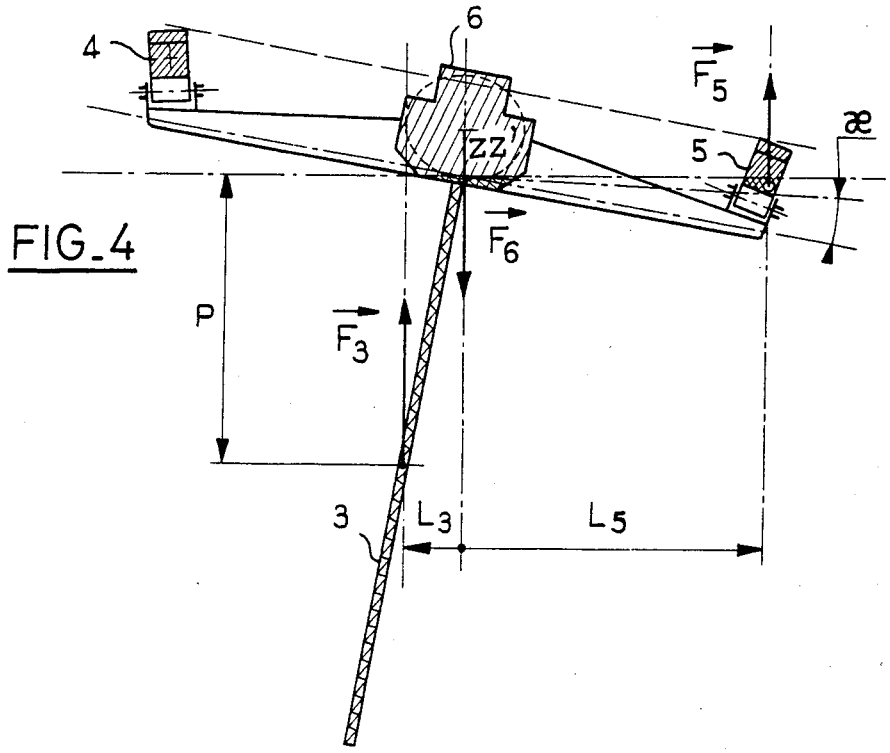
Figure 5:
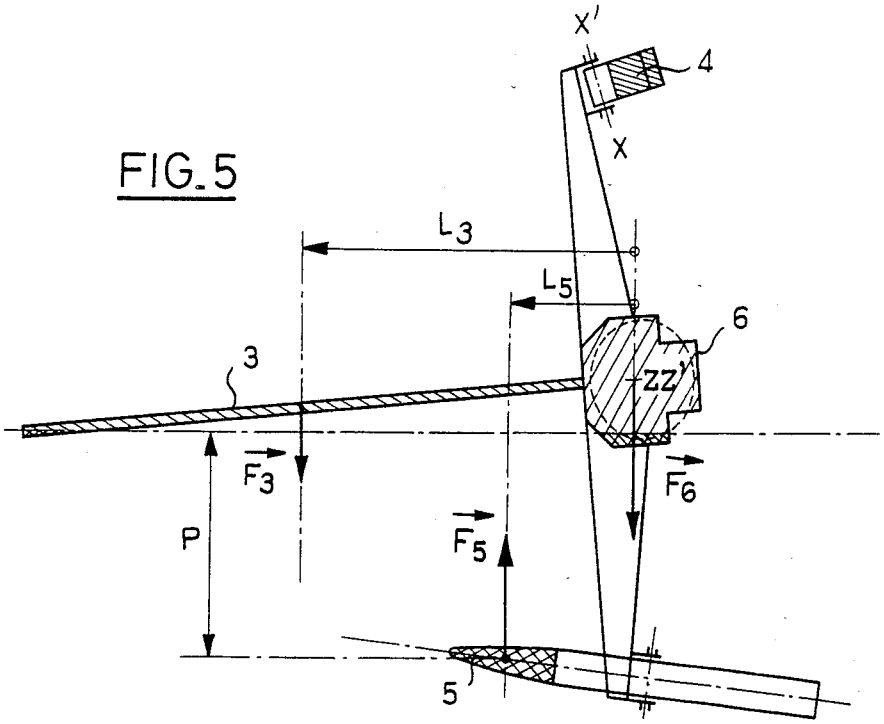
Figure 6:
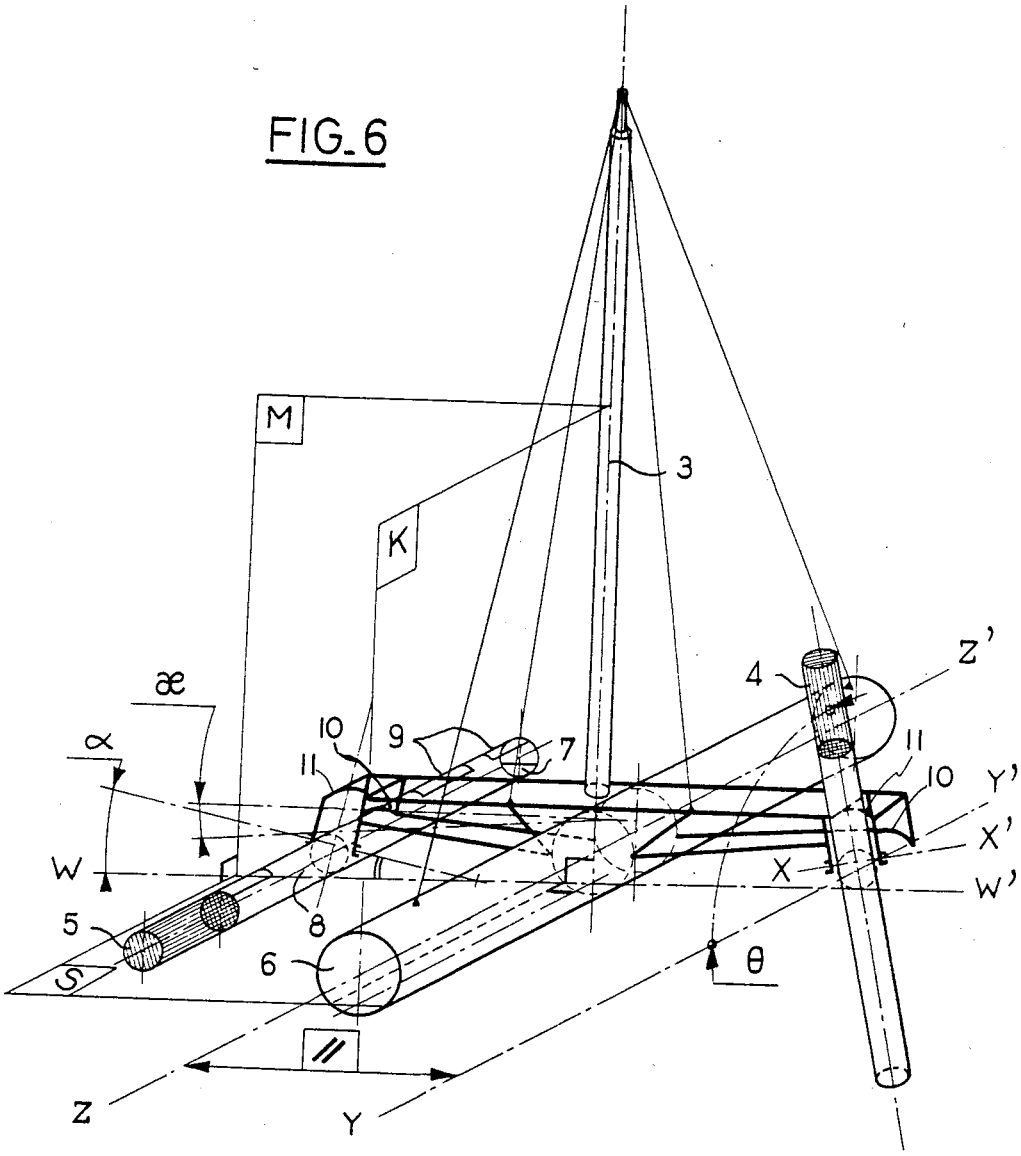

The accompanying drawings are drawn for the case in which the fluidtight volumes are nondeformable, for the case where the rotation of the float is automatic by the acute angle that the axis of rotation contained in a vertical plane forms. FIG. 1 is a perspective view of an embodiment, completed by FIG. 2, showing the design details of a float in three views in which the front view is in section. FIG. 3 shows the two positions obtained when it is in abutment (1) corresponding to an approximately horizontal position and in abutment (2) giving an almost vertical position. Abutment structures (10) and (11), as seen in FIG. 6, provide a means for achieving abutment positions (1) and (2), respectively. The two important phases of the operation are represented in FIG. 4 when the boat is overturned and in FIG. 5 when it recumbent on the water, the float having caused the rotation; only the forces necessary for the understanding of the operation are illustrated. FIG. 4 is a schematic drawing in perspective wherein the members are illustrated as tubes, the hatched volumes characterizing the essential fluidtight volumes.

As illustrated in FIGS. 1 and 2, the boat comprises a rotating mast (3) bearing against the central hull (6) which contains the axis (ZZ') of rotation of the boat. The floats (4) and (5) each have an axis (XX') of rotation which fixes them to a connecting beam having a pyramidal tubular structure yielding minimum volumes. A float represents a maximum hull volume which is submergible, determining a stability with full sails, and comprises a main fluidtight volume the center of buoyancy of which is (G1), a secondary volume the center of buoyancy of which is (G2), a quick discharge valve located at (7), and a volume (8) which may be fillable through the openings in deck (9), the nonsymmetry of the axis (XX') of rotation is defined by an acute angle ($\alpha$) formed between the axis (XX') and a straight line parallel to (WW'), contained in the plane (M) which is perpendicular to the plane (S) of the surface of the water and to the plane (K) of symmetry containing the axis (ZZ'). When sailing, the theoretical heel of the float in the wind has its center of buoyancy at (G) located in the plane (M) containing axis (XX'). When the float bears against abutment (10), its longitudinal axis (YY') is parallel to the axis (ZZ'), and its center of buyoancy is at (G'). This position is obtained in a first case when the float is not urged or in a second case when the boat has completely capsized. The position of the fluidtight volumes of each float relative to the new float line of the central hull (6) are such that the boat may roll on a side (ae) about its axis (ZZ') which remains as parallel as possible to the surface of the water when the means for righting it are in action. The force (F6) translates the resultant concerning the mass of the boat applied at the level of the central hull (6). At the beginning of the first phase, the mast (3) develops its potential energy translated, in FIG. 4, by the force (F3) exerted at a depth (P) with a lever arm (L3) permitting the start of rotation by submerging the float (5) and the connecting arms which oppose a potential energy translated by the force (F5) with a lever arm (L5). The variation of the volume of the float (5) occurs when the water fills the volume (8) through the openings in deck (9) by exhausting air through the quick discharge valve (7). The end of the first phase is achieved when the masthead of the mast (3) bears against the water. The transitional phase concerns the automatic rotation of the float (5) toward the abutment (2) for effecting an arbitrary angular rotation ($\theta$). When the float bears against the stop (2), the second phase begins. It is illustrated in FIG. 5. The forward volume may thus develop its potential energy translated by the force (F5) exerted at a depth (P) which a lever arm (L5) opposing the total mass of the mast (3) which furnishes work, translate by the force (F3) with a lever arm (L3). When the forward volume of the float emerges progressively, it causes a rotation toward the abutment (10), evacuating at the same time the water contained in the volume (8) through the openings in deck (9), the quick discharge valve (7) and the secondary volume (G2) also contributing to the return to an approximately horizontal heel of the float. The boat has thus returned to its normal sailing position.

The device, subject matter of the invention, is useable more particularly for trimaran type sail boats for all forms of sailing. It is applicable for high sea cruising or coastal boats, the seashore or racing craft, aircraft carrier boats or hydrofoils.

What is claimed is:

1. A self-stabilizing trimaran containing a central hull and a mast attached to said hull, the self-stabilizing apparatus comprising:

a first float rotatably attached about the hull's center of buoyancy and on the starboard side of the hull through a connecting arm;

a second float rotatably attached about the hull's center of buoyancy and on the port side of the hull through a connecting arm;

wherein each float contains first and second fluidtight volumes, the first fluidtight volume located in front of the point of attachment to the connecting arm, and the second fluidtight volume located behind the point of attachment to the connecting arm; and wherein each float has a freedom of rotation between a first abutment wherein the float is in a substantially horizontal position and a second abutment wherein the float is in a substantially vertical position.

2. The trimaran of claim 1, wherein each float contains a hollow volume fillable with fluid when the trimaran is recumbent, said volume being emptied upon righting of the trimaran by means of a quick discharge valve positioned in the stern of the float.

3. The trimaran of claim 2, wherein the rotational axis of the float is in a non-horizontal position, and wherein the stem of the float moves closer to the plane of symmetry of the trimaran when the float is in a non-horizontal position.

* * * * *